United States Patent [19]

Okajima et al.

[11] 4,323,195

[45] Apr. 6, 1982

[54] ROTARY-TYPE MELT APPLICATOR

[75] Inventors: Mutsuo Okajima, Narashino; Hideo Hisada, Tokyo, both of Japan

[73] Assignee: Shinto Paint Co., Ltd., Amagasaki, Japan

[21] Appl. No.: 165,236

[22] Filed: Jul. 2, 1980

Related U.S. Application Data

[63] Continuation of Ser. No. 949,101, Oct. 6, 1978, abandoned.

[30] Foreign Application Priority Data

Oct. 14, 1977 [JP] Japan ..... 52/123899

[51] Int. Cl.[3] ..... B05B 3/02

[52] U.S. Cl. ..... 239/215; 118/305

[58] Field of Search ..... 118/DIG. 1, DIG. 16, 118/323, 305, 300; 239/214, 215, 220

[56] References Cited

U.S. PATENT DOCUMENTS

| | | | |
|---|---|---|---|
| 785,089 | 3/1905 | Coddington | 118/423 X |
| 1,481,504 | 1/1924 | Chisholm | 239/220 X |
| 3,033,468 | 5/1962 | Lewes | 239/220 X |
| 3,279,425 | 10/1966 | Gottscho | 118/202 |
| 4,011,993 | 3/1977 | Mizuno et al. | 239/214 |

FOREIGN PATENT DOCUMENTS

| | | | |
|---|---|---|---|
| 143289 | 5/1920 | United Kingdom | 239/215 |

*Primary Examiner*—John P. McIntosh
*Attorney, Agent, or Firm*—Armstrong, Nikaido, Marmelstein, & Kubovcik

[57] ABSTRACT

A rotary-type melt applicator for forming pavement markings comprising a hopper for containing a marking composition having a composition outlet in its bottom and a plug-shaped member for opening or closing the outlet, with or without an oil bath surrounding the side wall of the hopper for maintaining the composition in a molten state, and a pair of rollers disposed adjacent to each other below the hopper, one of the rollers being a smooth-surfaced roller rotatable in a direction for feeding the marking composition to the other roller, the other roller being an applicator roller rotatable in a direction opposite to the direction of rotation of the feeding roller and having many sharp peripheral teeth extending axially thereof. The composition flowing out from the outlet onto the feeding roller is finely divided and scraped off therefrom by the sharp teeth of the applicator roller and then applied to a roadway surface.

5 Claims, 1 Drawing Figure

ROTARY-TYPE MELT APPLICATOR

Figure 1:
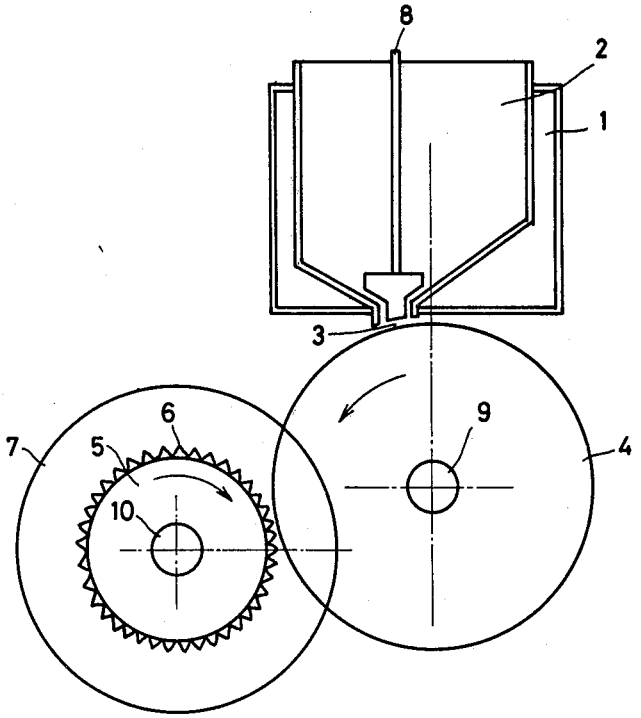

This is a continuation of application Ser. No. 949,101, filed Oct. 6, 1978, now abandoned.

The present invention relates to a rotary-type melt applicator for applying a marking composition to roadway surfaces to form traffic or pavement markings such as center lines and lane lines thereon.

Applicators for forming pavement markings on pavement surfaces by applying a molten composition thereto are generally divided into the hand-propelled type and the automotive type. Applicators of the latter type are subdivided into those of the air spray type and those of the airless spray type.

With applicators of the hand-propelled type, the marking composition is applied by gravity through a slit in the bottom of the applicator. Although capable of providing sharp markings with a desired finish, hand-propelled applicators require an inefficient manual labor and involve another drawback that the operator working on roadways is exposed to hazards especially in the presence of heavy vehicular traffic.

Air spray-type applicators by which the marking composition is pneumatically applied are adapted for a speedy operation with increased safety because they are automotive but have the drawback that the resulting markings are indistinct and liable to have reduced surface smoothness. Additionally glass beads, when incorporated in the marking composition, tend to clog up or markedly wear the applicator, thus entailing the necessity of applying the marking composition and glass beads separately.

Airless spray-type applicators, which are automotive and designed to force out the marking composition with direct application of pressure, also ensure an efficient operation with enhanced safety. However, they fail to give markings with a satisfactory finish and sufficient thickness and are not usable for compositions containing glass beads for the same cause as involved in the air spray type.

The main object of this invention is to overcome the foregoing drawbacks of conventional applicators and to provide an automotive rotary-type melt applicator which is capable of forming pavement markings at an increased speed, without entailing substantial hazards to the worker and with a satisfactory finish in sharpness, surface smoothness and thickness and which is further adapted for use with marking compositions incorporating glass beads.

The above object of the present invention can be fulfilled by an automotive rotary-type melt applicator comprising a hopper for containing a marking composition having a composition outlet in its bottom and a plug-shaped member for opening or closing the outlet, with or without an oil bath surrounding the side wall of the hopper for maintaining the composition in a molten state, and a pair of rollers disposed adjacent to each other below the hopper, one of the rollers being a smooth-surfaced roller rotatable in a direction for feeding the marking composition to the other roller, the other roller being an applicator roller rotatable in a direction opposite to the direction of rotation of the feeding roller and having a multiplicity of sharp peripheral teeth extending axially thereof.

This invention will be described below in greater detail with reference to a preferred embodiment shown in the accompanying drawing, in which:

The FIGURE is a side elevation in section schematically showing a rotary-type melt applicator of the invention including a hopper and two rollers.

With reference to the drawing, a marking composition preheated to a molten state is contained in a hopper 2. When desired, the hopper 2 may be provided with an oil bath 1 surrounding its side wall as illustrated. The marking composition is run off through an outlet 3 and fed onto a smooth-surfaced feeding roller 4 coupled to a power source such as a hydraulic motor. The roller 4 is driven at 25 to 200 r.p.m. in a counterclockwise direction in FIG. 1 to apply the marking composition to an applicator roller 5 at a constant rate. The roller 4, when driven at an altered speed, can form a marking of varied thickness as desired. The roller 4 must be smooth-surfaced. When the melt applicator is installed on a vehicle, the roller 4 is operatively associated with the propelling wheels of the vehicle, whereby the marking composition can be fed to the roller 5 at a definite rate independently of the speed of the vehicle.

The applicator roller 5 adjacent the roller 4 is coupled to a power source such as a diesel engine and rotated at a high speed of 3,500 to 5,000 r.p.m. in a direction opposite to the direction of rotation of the roller 4. The roller 5 has sharp peripheral teeth 6 extending axially thereof for finely dividing the marking composition when scraping the composition off the roller 4 and applies the composition to a roadway surface at a high speed.

The roller 4 has a larger radius than the roller 5. The shaft 9 of the roller 4 and the shaft 10 of the roller 5 must be positioned at different levels so that the marking composition can be applied perpendicularly to the roadway surface.

The multiplicity of teeth 6, if not pointed but merely a projection in cross section, will fail to finely divide the marking composition and to form distinct markings. Thus the teeth 6 must be sharp-tipped, preferably in a triangular, needlelike or bladelike shape. Such teeth may be formed by directly cutting out the periphery of a roll to the desired shape, or by detachably fitting sharp-tipped pieces in the periphery of a roll.

The composition outlet 3 disposed above the roller 4 must be located at a position away from a vertical center line of the roller 4 toward the direction of rotation of the roller 4 as illustrated. The bottom portion of the outlet must have the same radius of curvature as the roller 4 in section.

If the outlet 3 is not so positioned as specified above, the marking composition flowing out from the outlet 3 will stay on the roller 4, with the result that the roller 4 fails to feed the composition to the roller 5 at a constant rate.

The rate of discharge of the marking composition from the outlet 3 is adjustable by shifting the hopper 2 toward or away from the roller 4 in a horizontal direction at right angles to the roller shaft 9 and thereby varying the clearance between the outlet 3 and the roller 4.

The hopper 2 is provided with a plug-shaped closing member 8 which is coupled to a pneumatic cylinder to adjustably open or close the outlet 3 whereby the composition discharge rate is also adjustable.

The bottom end of the closing member 8, like the bottom of the outlet 3, must have the same radius of curvature as the roller 4 in section.

In order to confine the marking composition to a specified width upon application and form a sharp marking line or the like which otherwise would become indistinct due to the spread of the composition, the roller 5 needs to be provided with a disklike cover 7 on each of its opposite sides. When desired, a cover may be provided along the peripheries of the two rollers for preventing scattering of the marking composition.

What is claimed is:

1. A rotary-type melt applicator for applying a molten marking composition to a road surface to form traffic or pavement markings on a road comprising:

(a) only one composition applicator roller rotatable in a direction to apply molten marking composition to said surface and having a multiplicity of sharp peripheral teeth extending radially therefrom;

(b) only one smooth-surface feeder roller rotatable in a direction of rotation opposite from that of the applicator roller and disposed adjacent thereto for feeding molten marking composition to the applicator roller; and (c) only one hopper containing the molten marking composition disposed above the feeder and applicator rollers, the hopper having a marking composition outlet for feeding marking composition to the feeder roller and a plug-shaped closure member fitted to said outlet, the outlet having top and bottom portions with the bottom portion having the same radius of curvature as the feeder roller and said closure member having a bottom portion having the same radius of curvature as the feeder roller.

2. A rotary-type melt applicator as defined in claim 1 wherein the outlet of the hopper is disposed above the smooth-surfaced feeding roller at a position away from a vertical center line of the feeding roller toward the direction of rotation of the feeding roller.

3. A rotary-type melt applicator as defined in claim 1 wherein the smooth-surfaced feeding roller has a larger radius than the applicator roller, and the shafts of the two rollers are positioned at different levels to apply the marking composition to a roadway surface perpendicularly thereof.

4. A rotary-type melt applicator as defined in claim 1 wherein each of the two rollers is coupled to a power source.

5. A rotary-type melt applicator as defined in claim 1 further comprising hot oil bath means surrounding said hopper for keeping said marking composition molten.

* * * * *